US010059570B1

(12) United States Patent
Tollenaere

(10) Patent No.: US 10,059,570 B1
(45) Date of Patent: Aug. 28, 2018

(54) FRICTION LOCK SPREADER BAR

(71) Applicant: Donald John Tollenaere, West Union, SC (US)

(72) Inventor: Donald John Tollenaere, West Union, SC (US)

( * ) Notice: Subject to any disclaimer, the term of this patent is extended or adjusted under 35 U.S.C. 154(b) by 0 days.

(21) Appl. No.: 15/703,163

(22) Filed: Sep. 13, 2017

(51) Int. Cl.
*B66C 1/12* (2006.01)

(52) U.S. Cl.
CPC ..... *B66C 1/12* (2013.01)

(58) Field of Classification Search
CPC .. B66C 1/12; B66C 1/24; F16L 37/252; F16L 39/005; F16L 21/022; F16B 7/0413
See application file for complete search history.

(56) References Cited

U.S. PATENT DOCUMENTS 1,970,617 A * 8/1934 Morgan ..... B66C 1/663 294/74
3,206,243 A * 9/1965 Miles ..... B66C 1/66 192/150
4,397,493 A 8/1983 Khachaturian et al.
4,538,849 A * 9/1985 Khachaturian ..... B66C 1/12 294/81.1
5,603,544 A * 2/1997 Bishop ..... B66C 1/12 294/81.1
5,863,085 A 1/1999 Khachaturian
6,079,760 A 6/2000 Khachaturian
7,967,352 B2 6/2011 Di Martino
9,132,993 B1 9/2015 DiMartino et al.

OTHER PUBLICATIONS

Wire Rope Exchange; Versabar offers newly patented Versa-Adjust spreader bar; Internet Website: http://wireropeexchange.com/news/view/6992/versabar-offers-newly-patented-versa-adjust-spreader-bar; posted on Aug. 23, 2016; 3 pages.

* cited by examiner

*Primary Examiner* — Stephen A Vu
(74) *Attorney, Agent, or Firm* — Dority & Manning, P.A.

(57) ABSTRACT

A spreader bar includes an elongated shaft. A pair of friction locking cable couplings is mounted to elongated shaft. Each friction locking cable coupling includes a block with a curved engagement surface and a pair of pivots mounted to the block. The curved engagement surface of the block is shaped such that a cable is bent between the pair of pivots and the curved engagement surface of the block and static friction between the cable and the curved engagement surface of the block holds the cable against the block when the cable is received between the pair of pivots and the curved engagement surface of the block.

19 Claims, 7 Drawing Sheets

FRICTION LOCK SPREADER BAR

FIELD OF THE INVENTION

The present subject matter relates generally to spreader bars, such as spreader bars for use with loading systems for aircraft.

BACKGROUND OF THE INVENTION

Spreader bars assist with distributing loaded cables. For example, to load a helicopter within a transport aircraft, a cable from a winch within the transport aircraft may be connected to an apex, and two cables from the apex may be attached to the spreader bar. Two additional cables may extend from the spreader bar to the helicopter, and the spreader bar may position the additional cables such that the additional cables do not damage the helicopter, e.g., a pilot tube of the helicopter. In particular, the additional cables from the spreader bar may be generally parallel to each other between the spreader bar and the helicopter. The spreader bar may allow distributing the load of the helicopter across more than one point.

Spreader bars may assist with distributing vertically suspended loads in a similar manner. For example, two cables from a helicopter cargo hook may be attached to the spreader bar. Two additional cables may extend from the spreader bar to a load for the helicopter, and the helicopter load may be lifted through such cables. The spreader bar may position the additional cables such that the additional cables do not damage the helicopter load. In addition, the spreader bar may allow distributing the helicopter load across more than one point.

Known spreader bars have certain drawbacks. For example, connecting multiple cables to the spreader bars is a time consuming and difficult task. In addition, adjusting cable lengths to properly position spreader bars is difficult. Known spreader bars are also heavy, cumbersome and not easily adaptable to various loading arrangements.

Accordingly, a spreader bar with features for quickly and/or easily distributing loaded cables would be useful. In addition, a light and compact spreader bar for use during aircraft recovery would be useful.

BRIEF DESCRIPTION OF THE INVENTION

The present subject matter provides a spreader bar with an elongated shaft. A pair of friction locking cable couplings is mounted to elongated shaft. Each friction locking cable coupling includes a block with a curved engagement surface and a pair of pivots mounted to the block. The curved engagement surface of the block is shaped such that a cable is bent between the pair of pivots and the curved engagement surface of the block and static friction between the cable and the curved engagement surface of the block holds the cable against the block when the cable is received between the pair of pivots and the curved engagement surface of the block. Additional aspects and advantages of the invention will be set forth in part in the following description, or may be apparent from the description, or may be learned through practice of the invention.

In a first example embodiment, a spreader bar includes an elongated shaft that extends between a first end portion and a second end portion. A pair of friction locking cable couplings is mounted to elongated shaft. Each friction locking cable coupling of the pair of friction locking cable couplings is positioned at a respective one of the first and second end portions of the elongated shaft. Each friction locking cable coupling of the pair of friction locking cable couplings includes a block with a curved engagement surface and a pair of pivots mounted to the block. The pivots of the pair of pivots are spaced from the curved engagement surface of the block such that a cable is receivable between the pair of pivots and the curved engagement surface of the block. The curved engagement surface of the block is shaped such that the cable is bent between the pair of pivots and the curved engagement surface of the block and static friction between the cable and the curved engagement surface of the block holds the cable against the block when the cable is received between the pair of pivots and the curved engagement surface of the block.

In a second example embodiment, a loading system is provided. The loading system includes a spreader bar with an elongated shaft and a pair of friction locking cable couplings mounted to elongated shaft. Each friction locking cable coupling of the pair of friction locking cable couplings is positioned at an opposite end of the elongated shaft. At least one of the friction locking cable couplings of the pair of friction locking cable couplings includes a block with a curved engagement surface and a pair of pivots mounted to the block. The pivots of the pair of pivots are spaced from the curved engagement surface of the block. A cable is receivable between the pair of pivots and the curved engagement surface of the block. The curved engagement surface of the block is shaped such that the cable is bent between the pair of pivots and the curved engagement surface of the block and static friction between the cable and the curved engagement surface of the block holds the cable against the block when the cable is received between the pair of pivots and the curved engagement surface of the block.

In a third example embodiment, a spreader bar includes an elongated shaft that extending between a first end portion and a second end portion. The spreader bar also includes means for friction locking a cable to the elongated shaft at the first end portion of the elongated shaft and means for friction locking the cable or another cable to the elongated shaft at the second end portion of the elongated shaft.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
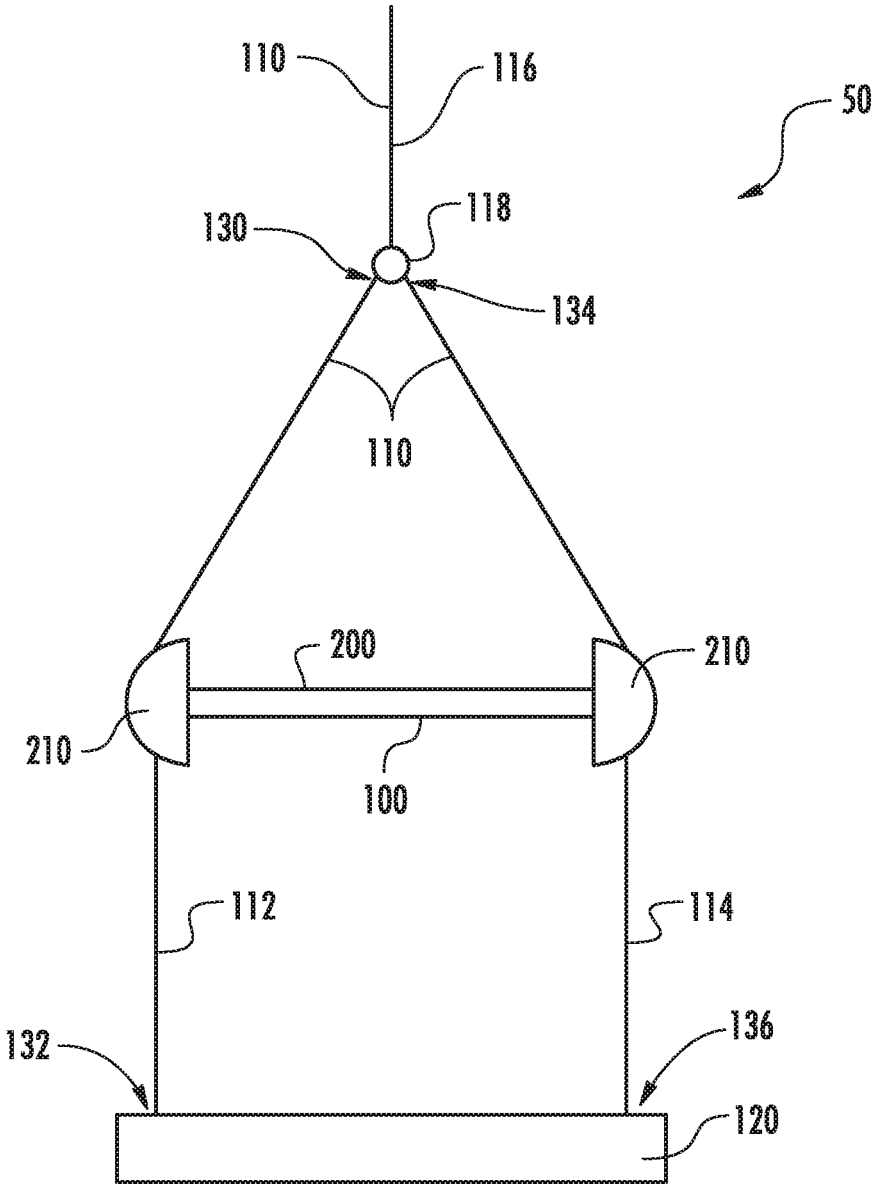
FIG. 1 provides a schematic view of a loading system according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a schematic view of a loading system 50 according to an example embodiment of the present subject matter. As may be seen in FIG. 1, loading system 50 includes a spreader bar 100 and cables 110. As discussed in greater detail below, spreader bar 100 assists with positioning cables 110 to facilitate movement of a load 120 with loading system 50. It will be understood that load 120 may be used to with any suitable load. For example, load 120 may be a helicopter or other aircraft.

Cables 110 include a first cable 112, second cable 114 and a third cable 116. Third cable 116 may be coupled to a winch (not shown) within a transport aircraft or a cargo hook (not shown) on a helicopter. Thus, third cable 116 may connect loading system 50 to the winch and allow the winch to pull load 120 into the transport aircraft via loading system 50. Similarly, third cable 116 may connect loading system 50 to the cargo hook and allow the helicopter to lift load 120 via loading system 50.

First and second cables 112, 114 may connect to third cable 116 at an apex 118. Apex 118 may be a buckle, lifting shackle, hook or other suitable coupling between first, second and third cables 112, 114, 116. As may be seen in FIG. 1, first cable 112 extends between a first end portion 130 and a second end portion 130, and second cable 114 also extends between a first end portion 134 and a second end portion 136. First end portions 130, 134 of first and second cables 112, 114 are positioned at and connected to apex 118. Conversely, second end portions 132, 136 of first and second cables 112, 114 are positioned at and connected to load 120. In particular, second end portions 132, 136 of first and second cables 112, 114 may be mounted to load 120 at opposite sides of load 120. As an example, second end portions 132, 136 of first and second cables 112, 114 may be connected to opposite sides or ends of an aircraft to assist with pulling or lifting the aircraft during transport or recovery of the aircraft.

As may be seen from the above, first and second cables 112, 114 extend between and connect apex 118 and load 120. Spreader bar 100 is coupled to first and second cables 112, 114 between apex 118 and load 120, and spreader bar 100 assists with positioning first and second cables 112, 114 to facilitate movement of load 120 with loading system 50. It will be understood that, without spreader bar 100, first and second cables 112, 114 would extend rectilinearly between apex 118 and load 120 when loading system 50 is used to move load 120 and first and second cables 112, 114 are in tension. Spreader bar 100 may be positioned on first and second cables 112, 114 to modify the path of first and second cables 112, 114 between apex 118 and load 120. For example, first and second cables 112, 114 may extend at a lesser angle between spreader bar 100 and load 120 compared to without spreader bar 100. Thus, e.g., spreader bar 100 may assist with preventing or limiting rubbing or other undesirable contact between load 120 and first and second cables 112, 114 during operation of loading system 50. As discussed in greater detail below, spreader bar 100 includes features for coupling or connecting spreader bar 100 to first and second cables 112, 114.

Figure 2:
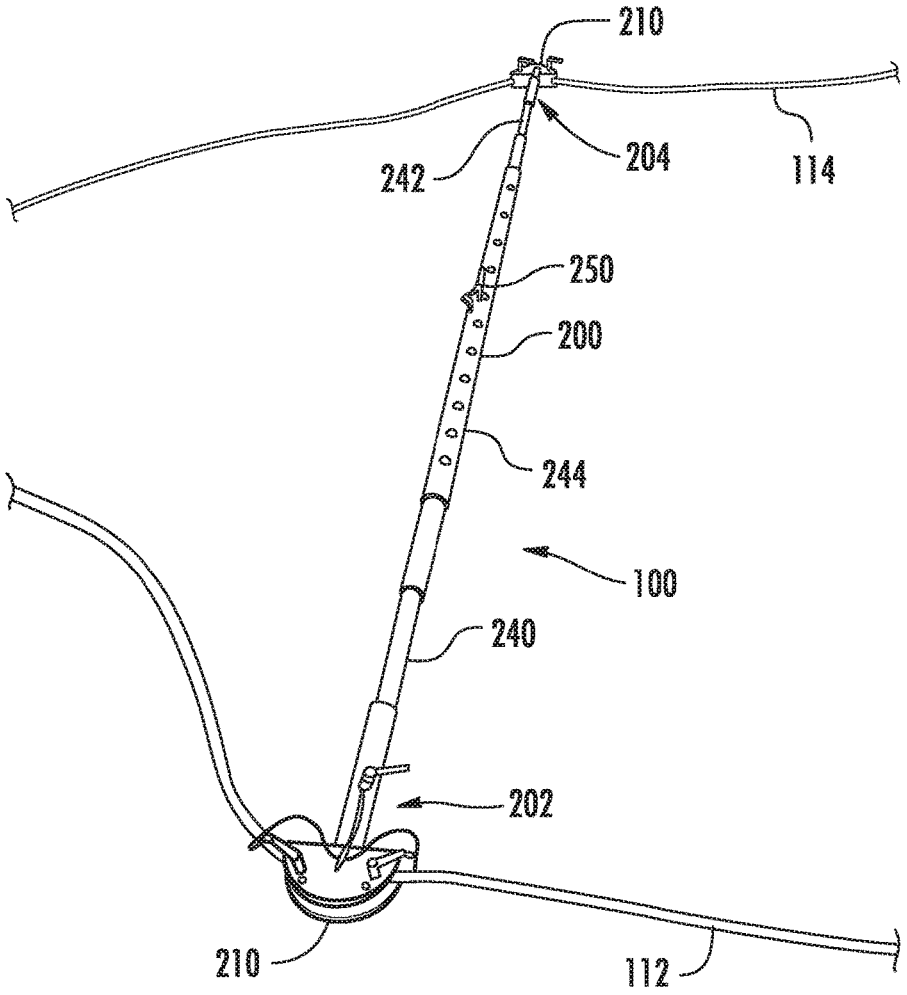
FIG. 2 provides a perspective view of a spreader bar and cables of the example loading system of FIG. 1.

FIG. 2 provides a perspective view of spreader bar 100 and first and second cables 112, 114 of loading system 50. As may be seen in FIG. 2, spreader bar 100 includes an elongated shaft 200 and a pair of friction locking cable couplings 210. Elongated shaft 200 extends between a first end portion 202 and a second end portion 204, e.g., that are positioned opposite each other on elongated shaft 200. Friction locking cable couplings 210 are mounted to elongated shaft 200. In particular, each friction locking cable coupling 210 may be positioned at a respective one of first and second end portions 202, 204 of elongated shaft 200. Thus, friction locking cable couplings 210 may be positioned at opposite ends of elongated shaft 200.

First cable 112 may be coupled to the one of friction locking cable couplings 210 at first end portion 202 of elongated shaft 200, and second cable 114 may be coupled to the other of friction locking cable couplings 210 at second end portion 204 of elongated shaft 200. First cable 112 may extend (e.g., continuously) through the one of friction locking cable couplings 210 between apex 118 and load 120. Similarly, second cable 114 may extend (e.g., continuously) through the other of friction locking cable couplings 210 between apex 118 and load 120. Thus, lifting system 50 may require only two cables 110 to connect apex 118 and spreader bar 100 with load 120 rather than the four cables needed with known spreader bars. As discussed in greater detail below, friction between cables 112, 114 and friction locking cable couplings 210 may selectively hold spreader bar 100 at a particular position on cables 112, 114 between apex 118 and load 120.

Figure 3:
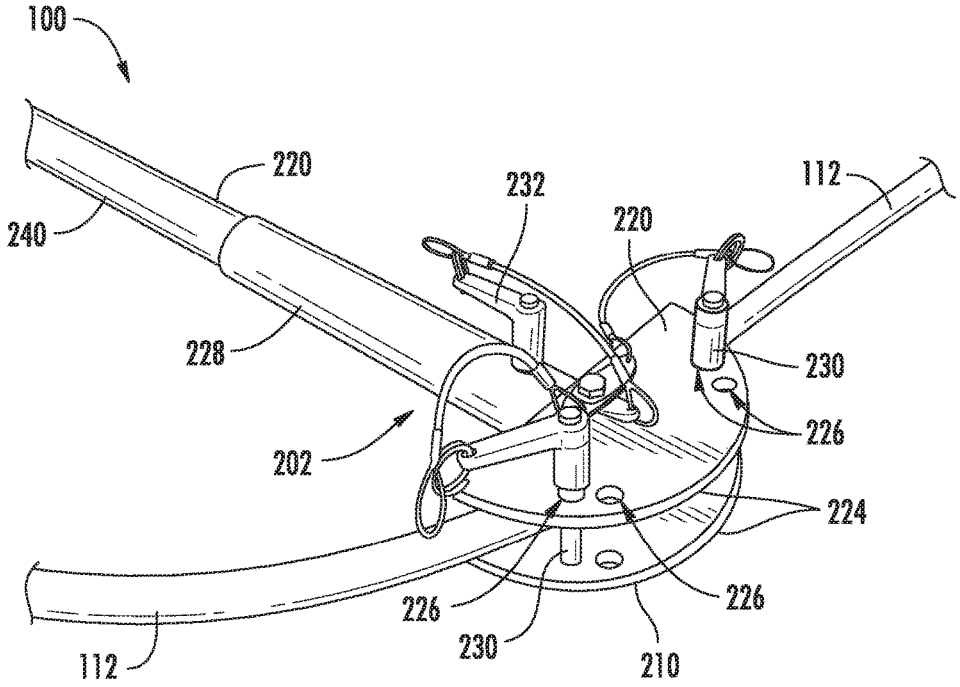
FIG. 3 provides a perspective view of a friction locking cable coupling of the spreader bar of FIG. 2.
Figure 4:
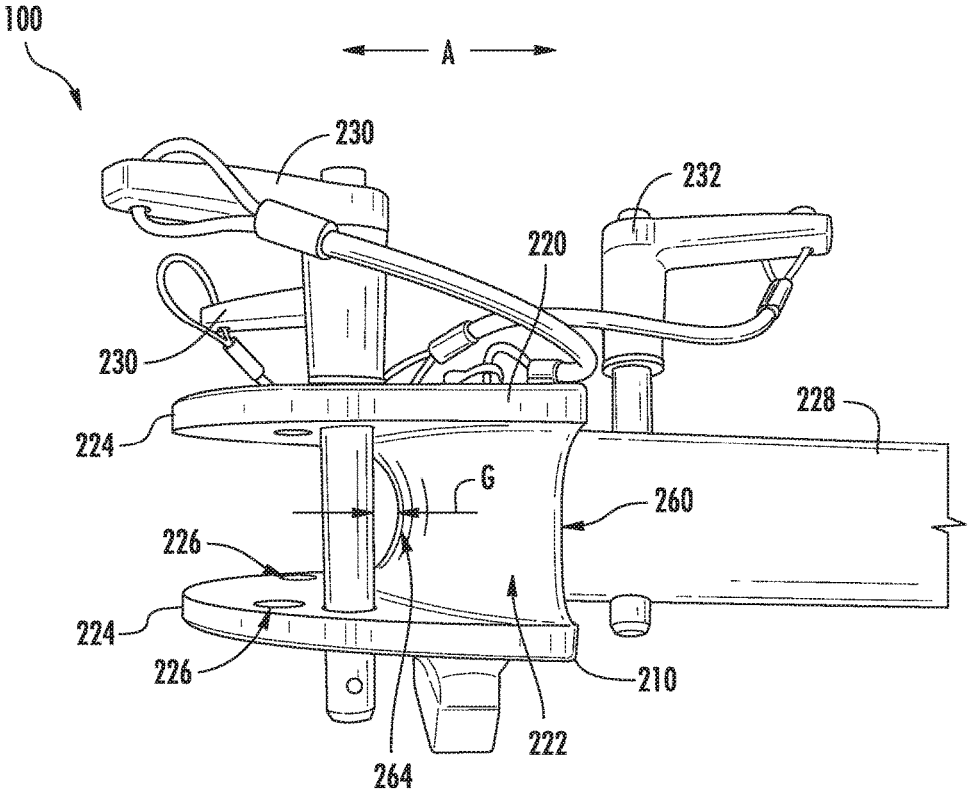
FIG. 4 provides a side, elevation view of the friction locking cable coupling of FIG. 3.
Figure 5:
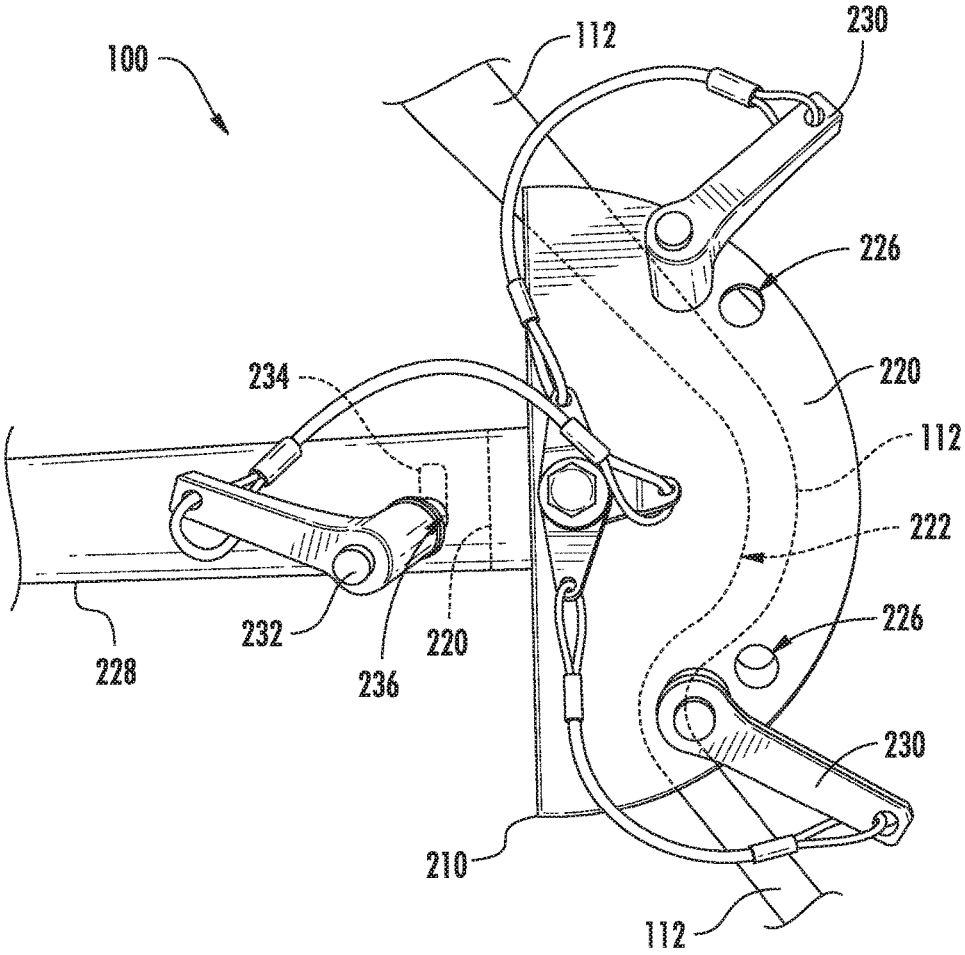
FIG. 5 provides a top, plan view of the friction locking cable coupling of FIG. 3.
Figure 6:
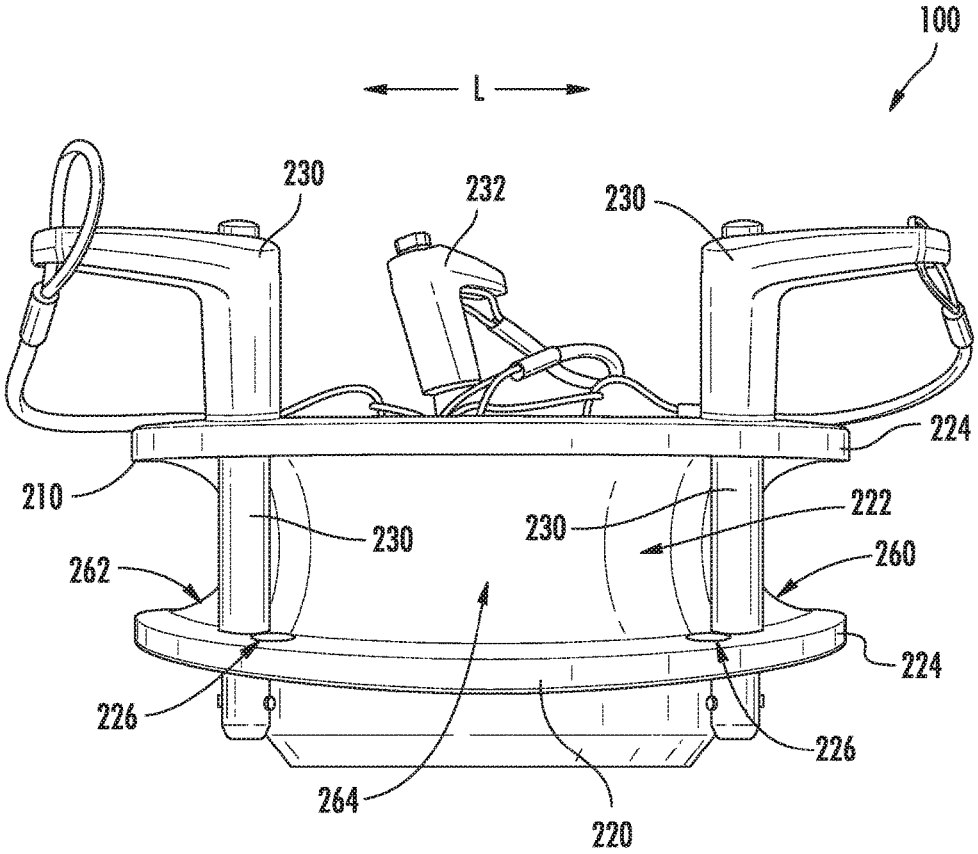
FIG. 6 provides a top, plan view of the friction locking cable coupling of the spreader bar of FIG. 2.

FIG. 3 provides a perspective view of friction locking cable coupling 210 of spreader bar 100. FIG. 4 provides a side, elevation view of friction locking cable coupling 210. FIG. 5 provides a top, plan view of friction locking cable coupling 210. FIG. 6 provides a top, plan view of friction locking cable coupling 210. Friction locking cable coupling 210 is discussed in greater detail below with reference to FIGS. 3 through 6.

Each of friction locking cable coupling 210 includes a block 220 and a pair of pivots 230 mounted to block 220. Block 220 has a curved engagement surface 222, and pivots 230 are mounted to block 220 such that pivots 230 are spaced from curved engagement surface 222 of block 220. Thus, first cable 112 is receivable between pivots 230 and curved engagement surface 222 of block 220. Curved engagement surface 222 of block 220 is shaped such that first cable 112 is bent between pivots 230 and curved engagement surface 222 of block 220 when first cable 112 is received between pivots 230 and curved engagement surface 222 of block 220. Thus, static friction between first cable 112 and curved engagement surface 222 of block 220 holds first cable 112 against block 220 when first cable 112 is received between pivots 230 and curved engagement surface 222 of block 220. It will be understood that while discussed herein in the context of the friction locking cable coupling 210 that engages first cable 112, the other of friction locking cable coupling 210 that engages second cable 114 may be constructed in the same or similar manner to couple second cable 114 to spreader bar 100.

Block 220 may be formed of or with aluminum. Thus, block 220 may be a machined aluminum block. Curved engagement surface 222 may also have an arcuate or semi-circular shape. Thus, curved engagement surface 222 may be an arcuate engagement surface. Block 220 may also include a pair of sidewalls 224 that are spaced apart from each other on block 220. Curved engagement surface 222 may be positioned between sidewalls 224, and pivots 230 may be mounted to block 220 by extending pivots between and/or through sidewalls 224 of block 220. Thus, first cable 112 may also be received between sidewalls 224 when first cable 112 is received between pivots 230 and curved engagement surface 222 of block 220.

Pivots 230 may be removable pins, such as ball lock pins. Thus, pivots 230 may be selectively mountable to block 220. In addition, each sidewall 224 may define four or more holes 226. A position of each pivot 230 on block 220 may be selectively adjustable by extending each pivot 230 through a respective one of holes 226 on each sidewall 224. Holes 226 may be spaced on sidewalls 224 to allow receipt of various diameter cables 110 between curved engagement surface 222 of block 220 and pivots 230. Thus, e.g., with reference to FIG. 5, each of pivots 230 may be moved to an adjacent one of holes 226 on sidewall 224 to accommodate a larger diameter cable than first cable 112.

Friction locking cable couplings 210 may be pivotally mounted to elongated shaft 200. For example, spreader bar 100 may include a mounting pin 232, e.g., a ball lock pin. Mounting pin 232 extends through elongated shaft 200 and friction locking cable coupling 210 in order to selectively mount friction locking cable coupling 210 to elongated shaft 200. For example, a post 228 may be mounted to block 220, and post 228 may be received on or within elongated shaft 200. In particular, an inner diameter of post 228 may be complementary to an outer diameter of elongated shaft 200 (e.g., at first end portion 202 or second end portion 204 of elongated shaft 200). Elongated shaft 200 may define a slot 234 (FIG. 5), and mounting pin 232 may be received within slot 234. In particular, mounting pin 232 may extend through post 228 at a hole 236 in post 228 of block 220 and then through elongated shaft 200 at slot 234. Slot 234 may be sized, e.g., elongated, such that friction locking cable coupling 210 is pivotable on elongated shaft 200. In particular, mounting pin 232 may slide within slot 234 to allow friction locking cable coupling 210 is pivotable relative to elongated shaft 200. In contrast, hole 236 of post 228 may be shaped complementary to mounting pin 232, e.g., both mounting pin 232 and hole 236 may have circular cross-sections. Pivotally mounting friction locking cable coupling 210 to elongated shaft 200, e.g., with slot 234, may assist with providing self-adjusting lifting or pulling angles, e.g., in vertical and horizontal planes, during use of loading system 50 when first cable 112 is in tension. In alternative example embodiments, slot 234 may be defined in post 228, e.g., when post 228 is received within elongated shaft 200.

Turning back to FIG. 2, elongated shaft 200 may include a first shaft segment 240, a second shaft segment 242 and a third shaft segment 244. Additional shaft segments (not shown) may also be added to elongated shaft 200 to increase a length of elongated shaft 200. Friction locking cable couplings 210 may be positioned at and mounted to a respective one of first and second shaft segments 240, 242, e.g., with posts 228 and mounting pins 232 as discussed above. First and second shaft segments 240, 242 may be mounted to third shaft segment 244 such that exposed lengths of first and second shaft segments 240, 242 from third shaft segment 244 are adjustable. Thus, e.g., first and second shaft segments 240, 242 may be slidable on or in third shaft segment 244 in order to adjust an overall length of spreader bar 100. Spreader bar 100 may also include locking pins 250, e.g., ball lock pins, that each extend through one of: (1) first shaft segment 240 and third shaft segment 244; and (2) second shaft segment 242 and third shaft segment 244 in order to lock such shaft segments together. Elongated shaft 200 may be formed of or with titanium. Thus, elongated shaft 200 may be a tubular titanium shaft or be constructed with tubular titanium segments. As another example, elongated shaft 200 may be a tubular aluminum and magnesium alloy shaft or be constructed with tubular aluminum and magnesium alloy segments. Utilizing titanium and/or aluminum and magnesium alloy in elongated shaft 200 may provide a strong and/or lightweight elongated shaft 200.

With reference to FIG. 6, curved engagement surface 222 may have a first end 260 and a second end 262. First and second ends 260, 262 may be positioned opposite each other on curved engagement surface 222. Pivots 230 are mounted to block 220 such that pivots 230 are positioned between first and second ends 260, 262 of curved engagement surface 222, e.g., along a direction L that is perpendicular to a length of elongated shaft 200. In addition, each pivot 230 may be spaced from curved engagement surface 222 (e.g., the closest portion of curved engagement surface 222) by more than the diameter of first cable 112 in order to allow receipt of first cable 112 between pivots 230 and curved engagement surface 222 while also allowing sliding of first cable 112 through friction locking cable coupling 210. As a particular example, each pivot 230 may be spaced from curved engagement surface 222 (e.g., the closest portion of curved engagement surface 222) by no greater than twice the diameter of first cable 112. Further, as shown in FIG. 4, curved engagement surface 222 has a peak 264 positioned between pivots 230 along the direction L. As shown in FIG. 4, peak 264 of curved engagement surface 222 may be spaced from pivots 230 by a gap G, e.g., along a direction A that is parallel to the length of elongated shaft 200 and/or perpendicular to the direction L. The gap G may be less than a diameter of the first cable 112. As a particular example, the gap G may be no greater than half the diameter of the first cable 112. The above described spacing of curved engagement surface 222 and pivots 230 may assist with friction locking of first cable 112 to block 220.

Spreader bar 100 with friction locking cable couplings 210 has numerous advantages over known spreader bars. For example, a position of friction locking cable couplings 210 on first and second cables 112, 114 may be selectively adjusted. In particular, when first and second cables 112, 114 are unloaded, a user of loading system 50 may slide first and second cables 112, 114 within friction locking cable couplings 210 to adjust the position of spreader bar 100 on first and second cables 112, 114. Thus, depending upon the desired configuration, the position of spreader bar 100 between apex 118 and load 120 may be adjusted to position either closer to apex 118 or closer to load 120. In addition, loading system 50 requires fewer cables than known spreader bars because first and second cables 112, 114 extend through and lock with spreader bar 100 rather than having four separate cables as with known spreader bars. Because no cable terminates at spreader bar 100, spreader bar 100 may have no lift points and adverse effects of non-compression loading on spreader bar 100 may be reduced relative to known spreader bars. In addition, the selective positioning of spreader bar 100 on first and second cables 112, 114 allows various lengths of first and second cables 112, 114 to be used without negatively affecting use of spreader bar 100 in loading system 50.

Loading system 50 may also be benefits over known loading systems. For example, loading system 50 may be advantageously lighter than known loading system. In particular, loading system 50 may collectively weigh less than thirty-five pounds. Thus, loading system 50 may be useful in aircraft recovery with a helicopter. In particular, loading system 50 can be a strong, light weight, low bulk loading system that improves worker safety associated with aircraft recoveries.

Figure 7:
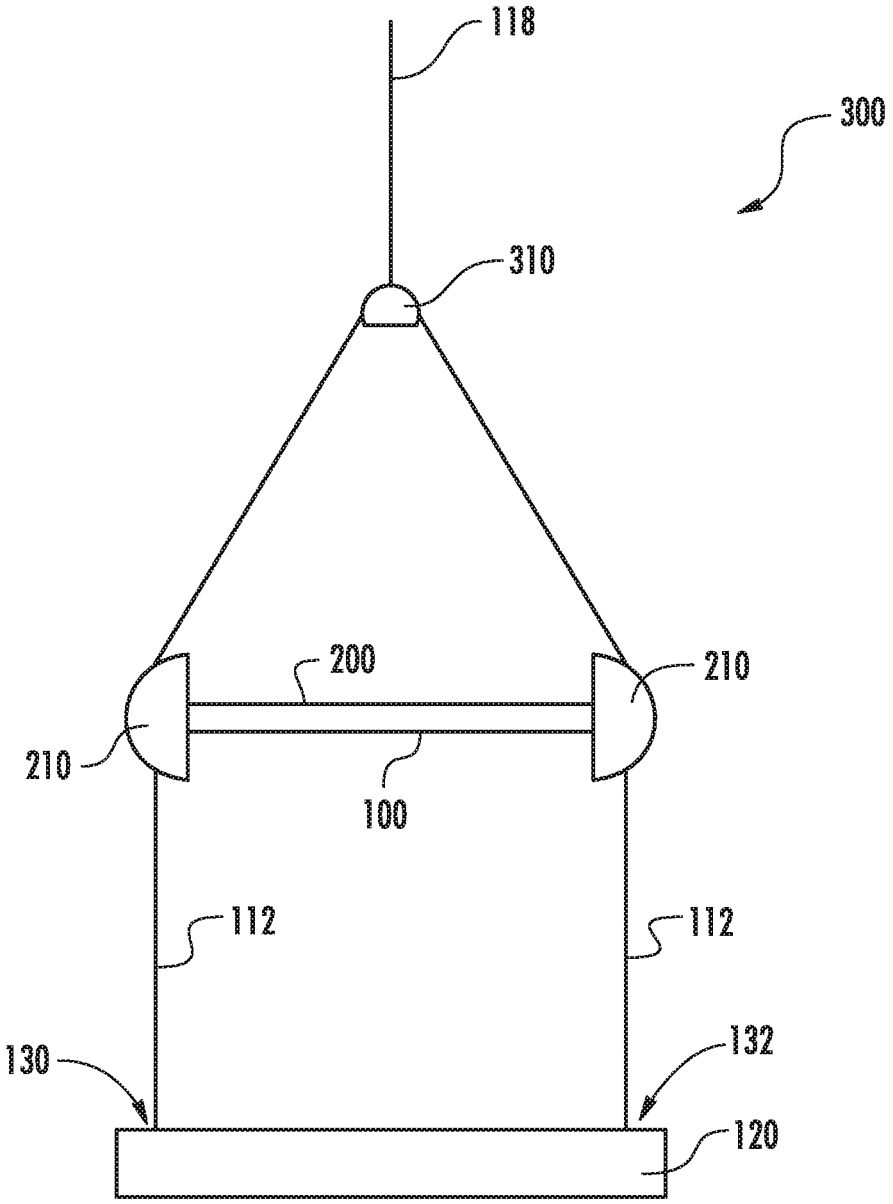
FIG. 7 provides a schematic view of a loading system according to another example embodiment of the present subject matter.

FIG. 7 provides a schematic view of a loading system 300 according to another example embodiment of the present subject matter. As may be see in FIG. 7, loading system 300 includes numerous common components with loading system 50 (FIG. 2). However, loading system 300 includes a friction locking apex 310 and does not include second cable 114. Rather, first cable 112 extends through friction locking apex 310 to both sides of load 120, and both friction locking cable couplings 210 of spreader bar 100 connect to first cable 112 in order to space segments of first cable 112 from each other. Thus, first cable 112 may extend through both friction locking cable couplings 210 of spreader bar 100, and first and second end portions 130, 132 of first cable 112 may be positioned and connected to load 120.

Friction locking apex 310 may be constructed in the same or similar manner to friction locking cable couplings 210 described above. However, friction locking apex 310 may include features for connecting to third cable 114. For example, friction locking apex 310 may include an adapter to facilitate a buckle, lifting shackle, hook, etc. As a particular example, the adapter may be a squared-off horse shoe that is form-fit over post 228 of friction locking apex 310 and with flat ears that extend beyond the curvature sidewalls 224. The flat ears may be drilled to accommodate a bolt and possible shim to safely attach a shackle or hook load beam.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spreader bar, comprising:

an elongated shaft extending between a first end portion and a second end portion;

a pair of friction locking cable couplings mounted to elongated shaft, each friction locking cable coupling of the pair of friction locking cable couplings positioned at a respective one of the first and second end portions of the elongated shaft, wherein a first friction locking cable coupling of the pair of friction locking cable couplings comprises a first block with a curved engagement surface; and a first pair of pivots mounted to the first block, the pivots of the first pair of pivots spaced from the curved engagement surface of the first block such that a cable is receivable between the first pair of pivots and the curved engagement surface of the first block, the curved engagement surface of the first block is shaped such that the cable is bent between the first pair of pivots and the curved engagement surface of the first block and static friction between the cable and the curved engagement surface of the first block holds the cable against the first block when the cable is received between the first pair of pivots and the curved engagement surface of the first block wherein a second friction locking cable coupling of the pair of friction locking cable couplings comprises a second block with a curved engagement surface; and a second pair of pivots mounted to the second block, the pivots of the second pair of pivots spaced from the curved engagement surface of the second block such that the cable or an additional cable is receivable between the second pair of pivots and the curved engagement surface of the second block, the curved engagement surface of the second block is shaped such that the cable or the additional cable is bent between the second pair of pivots and the curved engagement surface of the second block and static friction between the cable or the additional cable and the curved engagement surface of the second block holds the cable or the additional cable against the second block when the cable or the additional cable is received between the second pair of pivots and the curved engagement surface of the second block.

2. The spreader bar of claim 1, wherein a position of each of the friction locking cable couplings on the cable is selectively adjustable.

3. The spreader bar of claim 1, wherein the elongated shaft comprises tubular titanium.

4. The spreader bar of claim 1, wherein the first block is a machined aluminum block and the curved engagement surface is an arcuate engagement surface.

5. The spreader bar of claim 4, wherein the first block comprises a pair of sidewalls, the curved engagement surface positioned between the pair of sidewalls, the pivots extending through the pair of sidewalls.

6. The spreader bar of claim 5, wherein each sidewall of the pair of sidewalls defines at least four holes, a position of each pivot of the first pair of pivots on the first block selectively adjustable by extending each pivot of the first pair of pivots through a respective one of the of the at least four holes.

7. The spreader bar of claim 1, wherein the pivots of the first pair of pivots are removable pins that are selectively mountable to the first block.

8. The spreader bar of claim 1, further comprising a mounting pin that extends through the elongated shaft and one of the pair of friction locking cable couplings in order to selectively mount the one of the pair of friction locking cable couplings to the elongated shaft.

9. The spreader bar of claim 8, wherein a post of the first block or the elongated shaft defines a slot, the mounting pin received within the slot such that the one of the pair of friction locking cable couplings is pivotable on the elongated shaft.

10. The spreader bar of claim 8, wherein the elongated shaft comprises a first shaft segment, a second shaft segment and a third shaft segment, each friction locking cable coupling of the pair of friction locking cable couplings positioned at a respective one of the first and second shaft segments, the first and second shaft segments mounted to the third shaft segment such that exposed lengths of the first and second shaft segments from the third shaft segment are adjustable.

11. A loading system, comprising:

a spreader bar with an elongated shaft and a pair of friction locking cable couplings mounted to elongated shaft, each friction locking cable coupling of the pair of friction locking cable couplings positioned at an opposite end of the elongated shaft, a first one of the pair of friction locking cable couplings comprising a block with a curved engagement surface; and a pair of pivots mounted to the block, the pivots of the pair of pivots spaced from the curved engagement surface of the block;

a cable receivable between the pair of pivots and the curved engagement surface of the block, wherein the curved engagement surface of the block is shaped such that the cable is bent between the pair of pivots and the curved engagement surface of the block and static friction between the cable and the curved engagement surface of the block holds the cable against the block when the cable is received between the pair of pivots and the curved engagement surface of the block.

12. The loading system of claim 11, wherein the cable is a plastic coated cable.

13. The loading system of claim 11, wherein a position of the first one of the pair of friction locking cable couplings on the cable is selectively adjustable.

14. The loading system of claim 11, wherein the elongated shaft comprises tubular titanium.

15. The loading system of claim 11, wherein the block is a machined aluminum block and the curved engagement surface is an arcuate engagement surface.

16. The loading system of claim 15, wherein the block comprises a pair of sidewalls, the curved engagement surface positioned between the pair of sidewalls, the pivots extending through the pair of sidewalls.

17. The loading system of claim 16, wherein each sidewall of the pair of sidewalls defines at least four holes, a position of each pivot of the pair of pivots on the block selectively adjustable by extending each pivot of the pair of pivots through a respective one of the of the at least four holes.

18. The loading system of claim 11, further comprising a mounting pin that extends through the elongated shaft and the first of the pair of friction locking cable couplings in order to selectively mount the first one of the pair of friction locking cable couplings to the elongated shaft.

19. The loading system of claim 18, wherein a post of the block or the elongated shaft defines a slot, the mounting pin received within the slot such that the first one of the pair of friction locking cable couplings is pivotable on the elongated shaft.

* * * * *